US006364789B1

(12) United States Patent
Kosmatka

(10) Patent No.: US 6,364,789 B1
(45) Date of Patent: Apr. 2, 2002

(54) GOLF CLUB HEAD

(75) Inventor: John B. Kosmatka, Encinitas, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/475,754

(22) Filed: Dec. 30, 1999

(51) Int. Cl.[7] ..... A63B 53/04
(52) U.S. Cl. ..... 473/329; 473/342; 473/345
(58) Field of Search ..... 473/131, 290, 473/291, 292, 293, 324, 329, 332, 345, 342, 346, 347, 348, 349, 350, 288

(56) References Cited

U.S. PATENT DOCUMENTS 1,562,956 A * 11/1925 Guerne
3,937,474 A 2/1976 Jepson et al.
3,970,236 A 7/1976 Rogers
3,975,023 A 8/1976 Inamori
3,989,248 A 11/1976 Campau
4,252,262 A 2/1981 Igarashi
4,326,716 A 4/1982 Lacoste
4,398,965 A 8/1983 Campau
4,498,672 A 2/1985 Bulla
4,824,110 A 4/1989 Kobayashi
4,884,812 A 12/1989 Nagasaki et al.
5,261,663 A 11/1993 Anderson
5,261,664 A 11/1993 Anderson
5,271,621 A * 12/1993 Lo
5,299,807 A * 4/1994 Hutin
5,310,185 A 5/1994 Viollaz et al.
5,332,214 A 7/1994 Tucker, Sr.
5,364,103 A 11/1994 Chen et al.
5,398,929 A 3/1995 Kitaichi
5,403,007 A 4/1995 Chen
5,417,419 A 5/1995 Anderson et al.
5,431,396 A 7/1995 Shieh
5,447,311 A * 9/1995 Viollaz
5,458,334 A 10/1995 Sheldon et al.
5,460,371 A 10/1995 Takeda
5,467,983 A 11/1995 Chen
5,494,281 A 2/1996 Chen
5,505,453 A 4/1996 Mack
5,524,331 A 6/1996 Pond
5,588,922 A 12/1996 Schmidt et al.
5,703,294 A 12/1997 McConnell et al.
5,743,813 A 4/1998 Chen et al.
5,797,807 A 8/1998 Moore
5,816,936 A * 10/1998 Aizawa
5,863,261 A 1/1999 Eggiman
5,873,791 A 2/1999 Allen
5,888,148 A 3/1999 Allen
5,993,329 A * 11/1999 Shieh
6,001,030 A * 12/1999 Delaney
6,001,032 A * 12/1999 Onuki
6,042,486 A * 3/2000 Gallagher
6,083,117 A * 7/2000 Hsu
6,117,023 A * 9/2000 Onuki

* cited by examiner

*Primary Examiner*—Sebastiano Passaniti
(74) *Attorney, Agent, or Firm*—Michael A. Catania

(57) ABSTRACT

A golf club having a club head with a striking plate and an annular deflection enhancement member isolating the striking plate from the body of the golf club head. The annular deflection enhancement member is composed of a material having a Young's Modulus lower than that of the material of the striking plate. Thus, the striking plate may be composed of steel while the annular deflection enhancement member is composed of titanium.

7 Claims, 7 Drawing Sheets

GOLF CLUB HEAD

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a golf club head having a body with an annular deflection enhancement member for attachment of a striking plate thereto.

2. Description of the Related Art

When a golf club head strikes a golf ball, large impacts are produced that load the club head face and the golf ball. Most of the energy is transferred from the head to the golf ball, however, some energy is lost as a result of the collision. The golf ball is typically composed of polymer cover materials (such as ionomers) surrounding a rubber-like core. These softer polymer materials having damping (loss) properties that are strain and strain rate dependent which are on the order of 10–100 times larger than the damping properties of a metallic club face. Thus, during impact most of the energy is lost as a result of the high stresses and deformations of the golf ball (0.001 to 0.20 inches), as opposed to the small deformations of the metallic club face (0.025 to 0.050 inches). A more efficient energy transfer from the club head to the golf ball could lead to greater flight distances of the golf ball.

The generally accepted approach has been to increase the stiffness of the club head face to reduce metal or club head deformations. However, this leads to greater deformations in the golf ball, and thus increases in the energy transfer problem.

Some have recognized the problem and disclosed possible solutions. An example is Campau, U.S. Pat. No. 4,398,965, for a Method Of Making Iron Golf Clubs With Flexible Impact Surface, which discloses a club having a flexible and resilient face plate with a slot to allow for the flexing of the face plate. The face plate of Campau is composed of a ferrous material, such as stainless steel, and has a thickness in the range of 0.1 inches to 0.125 inches.

Another example is Eggiman, U.S. Pat. No. 5,863,261, for a Golf Club Head With Elastically Deforming Face And Back Plates, which discloses the use of a plurality of plates that act in concert to create a spring-like effect on a golf ball during impact. A fluid is disposed between at least two of the plates to act as a viscous coupler.

Yet another example is Jepson et al, U.S. Pat. No. 3,937,474, for a golf Club With A Polyurethane Insert. Jepson discloses that the polyurethane insert has a hardness between 40 and 75 shore D.

Still another example is Inamori, U.S. Pat. No. 3,975,023, for a Golf Club Head With Ceramic Face Plate, which discloses using a face plate composed of a ceramic material having a high energy transfer coefficient, although ceramics are usually harder materials. Chen et al., U.S. Pat. No. 5,743,813 for a Golf Club Head, discloses using multiple layers in the face to absorb the shock of the golf ball. One of the materials is a non-metal material.

Lu, U.S. Pat. No. 5,499,814, for a Hollow Club Head With Deflecting Insert Face Plate, discloses a reinforcing element composed of a plastic or aluminum alloy that allows for minor deflecting of the face plate which has a thickness ranging from 0.01 to 0.30 inches for a variety of materials including stainless steel, titanium, KEVLAR®, and the like. Yet another Campau invention, U.S. Pat. No. 3,989,248, for a Golf Club Having Insert Capable Of Elastic Flexing, discloses a wood club composed of wood with a metal insert.

Although the prior art has disclosed many variations of golf club heads, the prior art has failed to provide a golf club head that increases the energy transfer from the golf club striking plate to the golf ball through increased deflection of a conventional striking plate.

BRIEF SUMMARY OF THE INVENTION

The present invention provides a golf club head that is capable of imparting increased deflection of a striking plate composed of a rigid material during impact with a golf ball. The present invention is able to accomplish this by using an annular deflection enhancement member to isolate the striking plate from the body of the golf club head.

One aspect of the present invention is a golf club head including a body, a striking plate and an annular deflection enhancement member. The body has a hollow interior and a face opening thereto. The striking plate has an exterior surface and an interior surface. The annular deflection enhancement member is disposed between the body and the striking plate and isolates the striking plate from the body. The striking plate is composed of a first material and the annular deflection enhancement member is composed of a second material. The first material has a Young's Modulus greater than that of the second material. Preferably, the Young's Modulus of the second material is at least twenty-five percent lower than that of the first material. More preferably, the Young's Modulus of the second material is at least fifty percent lower than that of the first material.

The striking plate may be composed of stainless steel and the second material may be titanium, titanium alloys, copper, aluminum, brass, magnesium, ceramics, composites or polymer materials. Alternatively, the striking plate may be composed of titanium, and the second material would then be composed of copper, aluminum, brass, magnesium, ceramics, composites or polymer materials. Yet further, the striking plate may be composed of an even softer material than titanium, and the second material would generally be a polymer material. The polymer materials would have a low dampening (loss) factor so that the deformation of the polymer doesn't increase energy losses during impact with a golf ball.

The softer annular deflection enhancement member will reduce the stiffness of the striking plate. Thus, during impact with a golf ball, the striking plate will more easily deform or deflect, thus decreasing the deformation of the golf ball. Moreover, the contact time between the striking plate and the golf ball will increase thereby lowering the strain rate deformation of the golf ball. These factors will significantly decrease the energy lost during impact, or stated differently, these factors will increase the energy transfer from the golf club to the golf ball. The energy transfer will result in a golf club head having an increased coefficient of restitution. The coefficient of restitution is measured under test conditions, such as those specified by the USGA. The standard USGA conditions for measuring the coefficient of restitution is set forth in the *USGA Procedure for Measuring the Velocity*

*Ratio of a Club Head for Conformance to Rule* 4-1*e, Appendix II. Revision I, Aug.* 4, 1998 *and Revision* 0, *Jul.* 6, 1998, available from the USGA.

Another aspect of the present invention is an iron golf club head. The iron golf club head has a body, a striking plate and an annular deflection enhancement member. The body has a shallow hollow interior and a face opening thereto. The striking plate has an exterior surface and an interior surface. The annular deflection enhancement member is disposed between the body and the striking plate, and isolates the striking plate from the body. The striking plate is composed of a first material and the annular deflection enhancement member is composed of a second material. The first material has a Young's Modulus greater than that of the second material. Preferably, the Young's Modulus of the second material is at least twenty-five percent lower than that of the first material. More preferably, the Young's Modulus of the second material is at least fifty percent lower than that of the first material.

Yet another aspect of the present invention is a body, a striking plate and an deflection enhancement means having a Young's modulus lower than that of the striking plate. The deflection enhancement means may be the material of the body modified from the rest of the body or a solder.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
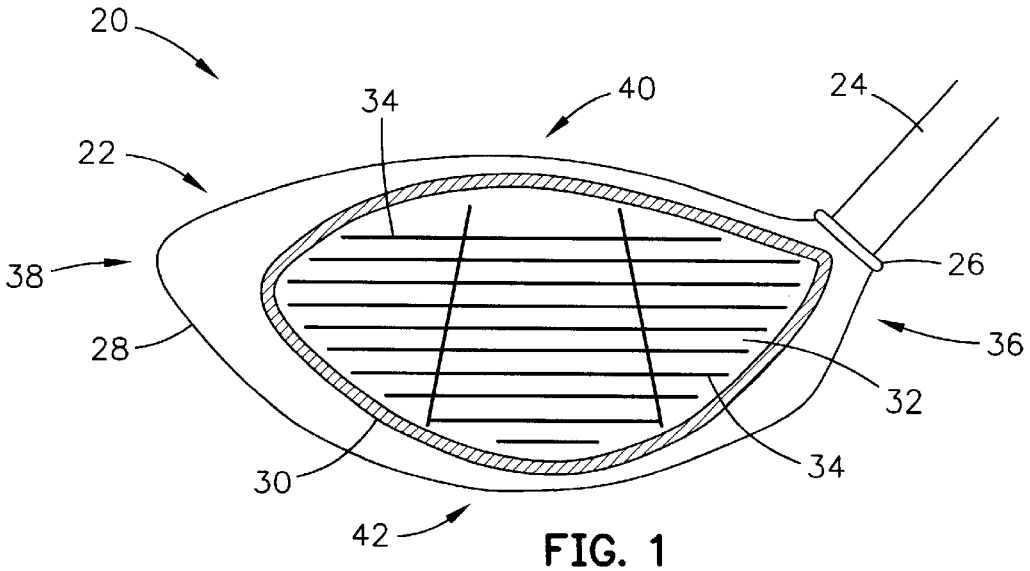
FIG. 1 is a front plan view of a golf club head of the present invention.
Figure 2:
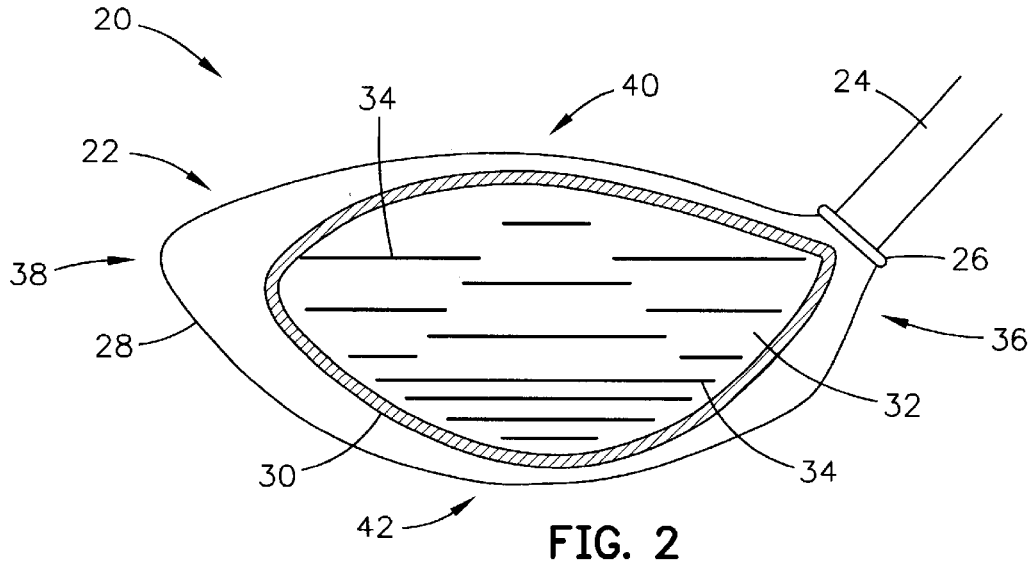
FIG. 2 is a front plan view of an alternative embodiment of a golf club head of the present invention.

The present invention is directed at a golf club head having a gasket that isolates the striking plate from the entirety of the body of the golf club head. This isolation of the striking plate allows for a golf club head with a high coefficient of restitution thereby enabling for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face. The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head having a coefficient of restitution approaching 0.9, as measured under conventional test conditions.

As shown in FIGS. 1–5, a golf club is generally designated 20. The golf club 20 has a club head 22 that is engaged with a shaft 24. A ferrule 26 encircles the shaft 24 at an aperture 27 to a hosel 29. The club head 22 has a body 28, an annular deflection enhancement member 30 and a striking plate 32. The annular deflection enhancement member 30 encompasses the perimeter of the striking plate 32 thereby isolating the striking plate 32 from the entirety of the club head body 28. The striking plate 32 may have a plurality of scorelines 34 thereon. The striking plate 32 generally extends from a heel end 36 of the club head 22 to a to end 38 of the club head 22.

Figure 3:
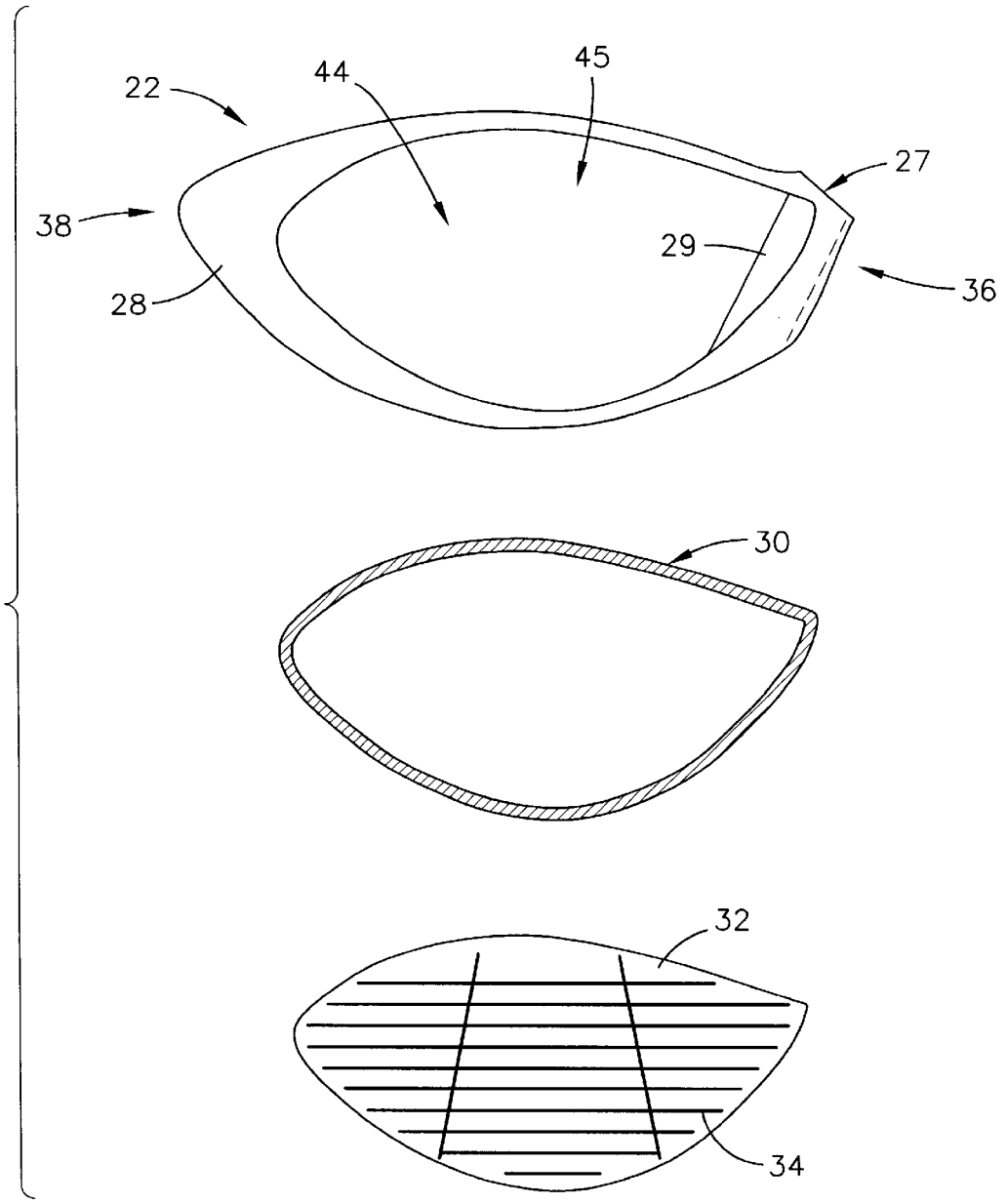
FIG. 3 is an exploded view of the golf club head of FIG. 1.
Figure 3A:
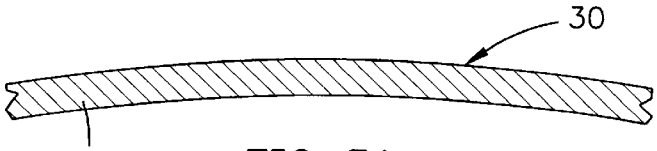
FIG. 3A is an isolated top plan view of a portion of the gasket of the present invention.
Figure 3B:
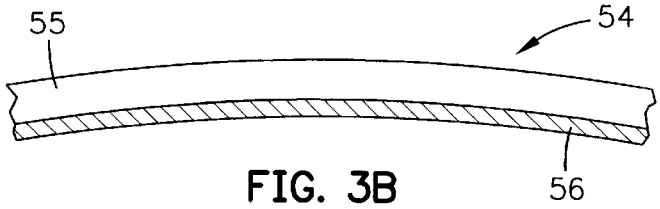
FIG. 3B is an isolated plan view of the crown/face transition area of the golf club head of present invention.
Figure 5:
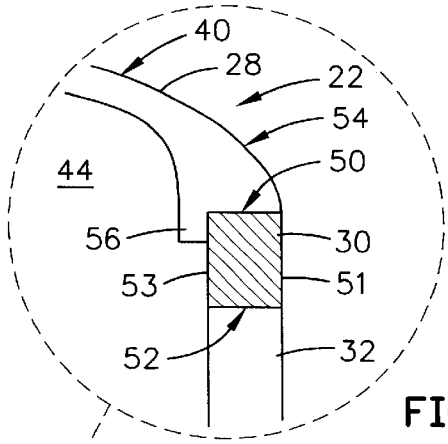
FIG. 5 is an enlarged view of circle 5 of FIG. 4.
Figure 4:
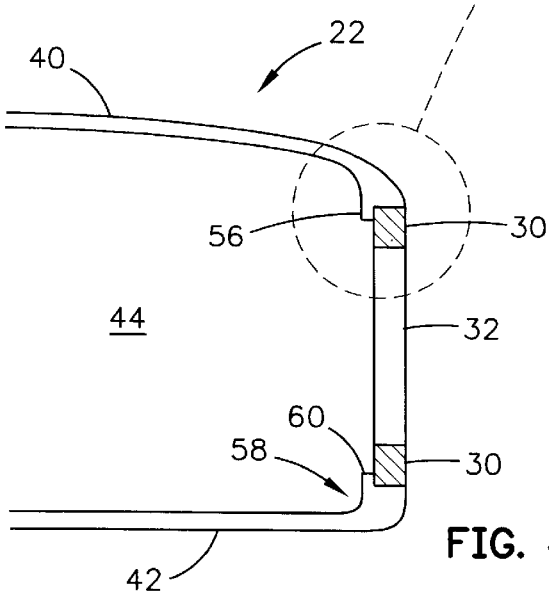
FIG. 4 is a cross-sectional view of the golf club head of FIG. 1.

The body 28 has a crown 40 and a sole 42. As shown in FIG. 3, the body 28 has a hollow interior 44. Positioned inside the hollow interior 44 is the hosel 29. The body also has a front opening 45 for positioning of the annular deflection enhancement member 30 and striking plate 32 therein. Alternatively, the annular deflection enhancement member 30 may be composed of a plurality of portions 31*a–d* which may range from two to twenty.

The annular deflection enhancement member 30 has an upper surface 50, an exterior surface 51, a lower surface 52 and an interior surface 53. As shown in FIGS. 3A, 3B, 4 and 5, the upper surface 50 of the annular deflection enhancement member 30 engages a crown/face transition area 54 of the body 28 while the interior surface 53 engages a shoulder 56 of the crown/face transition area 54. A sole/face transition area 58, with a shoulder 60, engages the lower portion of the annular deflection enhancement member 30 similar to the annular deflection enhancement member 30 engagement with the crown/face transition area 54. Preferably, the annular deflection enhancement member 30 and striking plate 32 are press-fitted into the opening 45 of the body 28 under high pressure to ensure a secure fitting. In addition to the mechanical adhesion, a chemical adhesion may be used to ensure a secure fitting. The chemical adhesion may be implemented through heating of the materials (if only metal materials are employed) or through an adhesive material such as an epoxy or polyurethane adhesive. However, an adhesive component may have a small dampening effect during impact with a golf ball. Additionally, the annular deflection enhancement member 30 may be molded or cast in position about the opening 45 of the body 28.

The striking plate 32 is generally composed of a single piece of metal, and is preferably composed of steel or titanium. However, the striking plate 32 may be composed of a composite material such as carbon fibers dispersed with a resin sheet. However, those skilled in the relevant art will recognize that the striking plate 32 may be composed of other materials such as vitreous metals, ceramics, other fibrous materials, and the like without departing from the scope and spirit of the present invention. The thickness of the striking plate 32 may range from 0.010 inches to 0.200, and the striking plate may have a non-uniform thickness such as disclosed in U.S. Pat. No. 5,830,084 for a Contoured Golf Club Face which is hereby incorporated by reference.

The annular deflection enhancement member 30 has a Young's Modulus that is lower than the Young's Modulus of the striking plate 32. Preferably, the annular deflection enhancement member 30 has a Young's Modulus that is twenty-five percent lower than the Young's Modulus of the striking plate 32, and most preferably the annular deflection enhancement member 30 has a Young's Modulus that is fifty percent lower than the Young's Modulus of the striking plate 32. However, the annular deflection enhancement member 30 may have a Young's modulus that is only ten percent less than the striking plate 32. The Young's Modulus is a measurement of the elastic modulus or stiffness of a material. For example, if the striking plate 32 is composed of stainless steel, it has a Young's Modulus of $2\times10^{11}$ Pascals, and thus the annular deflection enhancement member 30 must have a Young's Modulus no greater than $1.5\times10^{11}$ Pascals. Thus, the annular deflection enhancement member 30 may be composed of titanium (Young Modulus of $1.1\times10^{11}$ Pascals), copper or brass (Young Modulus of $1.1\times10^{11}$ Pascals), aluminum (Young Modulus of $6.8\times10^{10}$ Pascals), magnesium (Young Modulus of $4.4\times10^{10}$ Pascals), a polymer material (Young Modulus of $0.0007–1.4\times10^{10}$ Pascals), lead (Young Modulus of $1.8\times10^{10}$ Pascals), nickel (Young Modulus of $4.6\times10^{10}$ Pascals), tin (Young Modulus of $4.0\times10^{10}$ Pascals), glass/epoxy (Young Modulus of $1.4–0.8\times10^{10}$ Pascals), graphite/epoxy (Young Modulus of $5.0–30\times10^{10}$ Pascals), kevlar/epoxy (Young Modulus of $1.4–7.5\times10^{10}$ Pascals), wood (Young Modulus of $0.68–1.7\times10^{10}$ Pascals), or the like. If the striking plate 32 is composed of a stainless steel material, then the annular deflection enhancement member 30 is preferably composed of a copper material.

In an alternate example, if the string plate 32 is composed of titanium, it has a Young's Modulus of $1.1\times10^{11}$ Pascals, and thus the annular deflection enhancement member 30 should have a Young's Modulus no greater than $0.825\times10^{11}$ Pascals. Thus, the annular deflection enhancement member 30 may be composed of copper or brass (Young Modulus of $1.1\times10^{11}$ Pascals), aluminum (Young Modulus of $6.8\times10^{11}$ Pascals),magnesium (Young Modulus of $4.4\times10^{10}$ Pascals), a polymer material (Young Modulus of $0.0007–1.4\times10^{10}$ Pascals), lead (Young Modulus of $1.8\times10^{10}$ Pascals), nickel (Young Modulus of $4.6\times10^{10}$ Pascals), tin (Young Modulus of $4.0\times10^{10}$ Pascals), glass/epoxy (Young Modulus of $1.4–0.8\times10^{10}$ Pascals), graphite/epoxy (Young Modulus of $5.0–30\times10^{10}$ Pascals), kevlar/epoxy (Young Modulus of $1.4–7.5\times10^{10}$ Pascals), wood (Young Modulus of $0.68–1.7\times10^{10}$ Pascals), or the like. If the striking plate 32 is composed of titanium, then the annular deflection enhancement member 30 is preferably composed of a magnesium material.

In yet another example, if the striking plate 32 is composed of a composite material, it has a Young's Modulus of $3–20\times10^{10}$ Pascals, and thus the annular deflection enhancement member 30 must have a Young's Modulus no greater than $2–15\times10^{10}$ Pascals. Thus, the annular deflection enhancement member 30 is composed of a polymer material such as a polyurethane, a polyethylene or an ionomer material.

As mentioned previously, the annular deflection enhancement member 30 isolates the striking plate 32 from the entirety of the body 28 allowing for greater deflection of the striking plate 32 during impact with a golf ball. The compliance of the striking plate 32 during impact with the golf ball allows for a coefficient of restitution greater than that of a continuous head. This compliance of the striking plate 32 is possible even though the striking plate may be fairly rigid, and non-compliant if engaged with the body 28. However, the annular deflection enhancement member 30, with a Young's Modulus at least twenty-five percent lower than that of the striking plate 32, allows for compliance of the striking plate 32 during impact with a golf ball.

Figure 6:
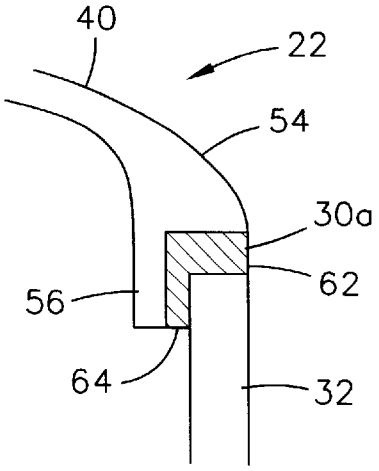
FIG. 6 is an isolated cross-sectional view of an alternative embodiment of the gasket, striking plate and body interface of the present invention.

FIGS. 6–13 illustrate different embodiments of the annular deflection enhancement member 30, striking plate 32 and body 28 interface. As shown in FIG. 6, the annular deflection enhancement member 30*a* has an "L" shape with a upper portion 62 and a lower portion 64. The striking plate 32 engages both the upper and lower portions 62 and 64 of the annular deflection enhancement member 30*a*.

Figure 7:
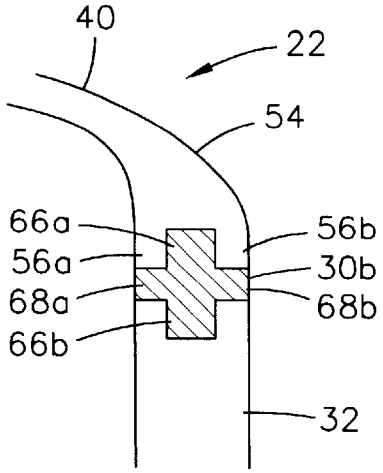
FIG. 7 is an isolated cross-sectional view of an alternative embodiment of the gasket, striking plate and body interface of the present invention.

As shown in FIG. 7, the annular deflection enhancement member 30*b* has a cross shape with upper and lower portions 66*a–b*, and forward and rearward portions 68*a–b*. The crown/face transition area 54 has two extensions 56*a–b* that form a cavity for engagement with the upper portion 66*a* of the annular deflection enhancement member 30*b*. The striking plate 32 has a perimeter cavity for receiving the lower portion 66*b* of the annular deflection enhancement member 30*b*.

Figure 8:
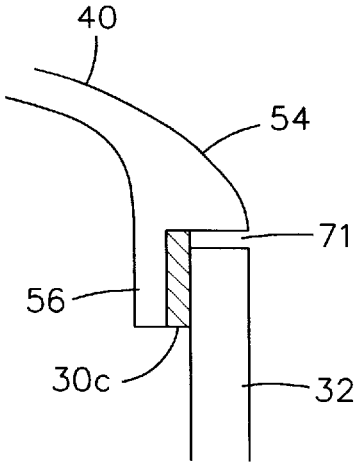
FIG. 8 is an isolated cross-sectional view of an alternative embodiment of the gasket, striking plate and body interface of the present invention.

As shown in FIG. 8, the annular deflection enhancement member 30*c* is disposed behind the striking plate 32, primarily engaging the shoulder 56 and the interior surface of the striking plate 32. A small gap 71 lies between the striking plate 32 and crown/face transition area 54.

Figure 9:
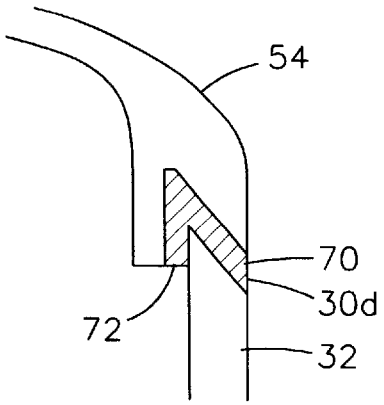
FIG. 9 is an isolated cross-sectional view of an alternative embodiment of the gasket, striking plate and body interface of the present invention.
Figure 10:
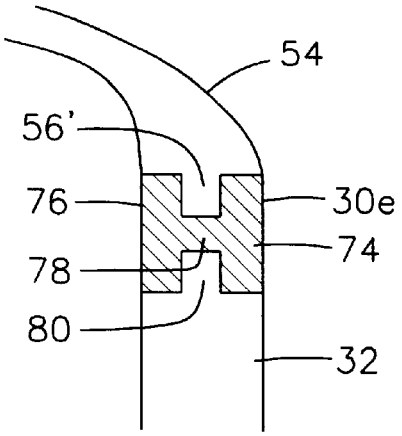
FIG. 10 is an isolated cross-sectional view of an alternative embodiment of the gasket, striking plate and body interface of the present invention.
Figure 11:
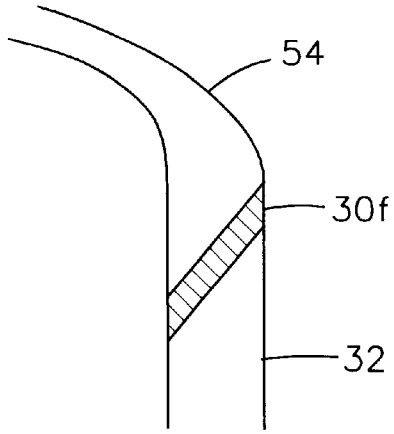
FIG. 11 is an isolated cross-sectional view of an alternative embodiment of the gasket, striking plate and body interface of the present invention.

FIGS. 9–11 are primarily directed at annular deflection enhancement members 30*d–f* composed of injectable materials such as thermoplastic materials and injectable metals. However, the annular deflection enhancement members 30*d–f* may be non-injectable materials. As shown in FIG. 9, the annular deflection enhancement member 30*d* has an angled portion 70 and a straight portion 72. The crown/face transition area 54 has a cavity to receive the annular deflection enhancement member 30*d*, and the striking plate 32 is angled to engage the annular deflection enhancement member 30*d*. The annular deflection enhancement member 30*e* of FIG. 10 has an "H" shape with a forward portion 74, a rearward portion 76 and a middle portion 78. The crown/face transition area 54 has a projection 56' that engages the annular deflection enhancement member 30*e*, and the striking plate 32 has a projection 80 that engages the annular deflection enhancement member 30*e*. The annular deflection enhancement member 30*f* of FIG. 11 is angled to match the angle of the striking plate 32 and the crown/face transition area 54.

Figure 12:
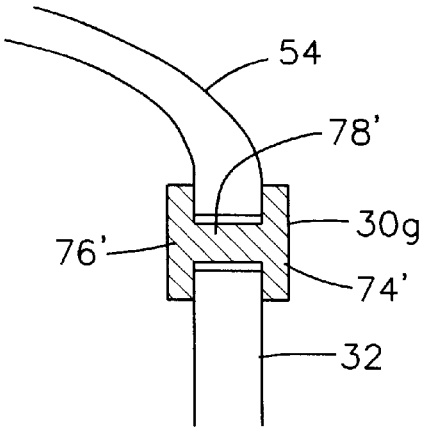
FIG. 12 is an isolated cross-sectional view of an alternative embodiment of the gasket, striking plate and body interface of the present invention.
Figure 13:
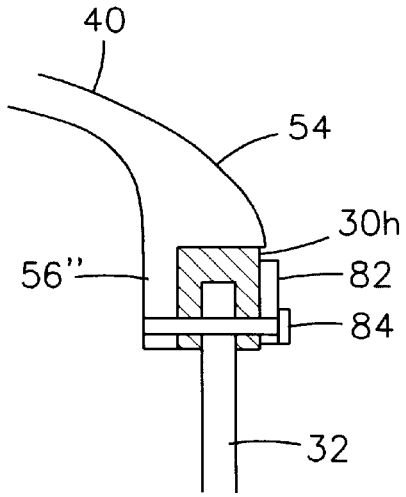
FIG. 13 is an isolated cross-sectional view of an alternative embodiment of the gasket, striking plate and body interface of the present invention.

FIGS. 12 and 13 illustrate annular deflection enhancement members 30*g* and 30*h* that are mechanically secure. The annular deflection enhancement member 30*g* has an "H" shape with a forward portion 74', a rearward portion 76' and a middle portion 78'. The crown/face transition area 54 engages the annular deflection enhancement member 30*g* within the forward and rearward portions 74' and 76', and the striking plate 32 engages the annular deflection enhancement member 30*e* within the forward and rearward portions 74' and 76'. The annular deflection enhancement member 30h has a "U" shape. A front plate 82 is attached by a pin 84 that also secures the striking plate and the annular deflection enhancement member 30*h* to the shoulder 56" of the body 28.

Figure 14:
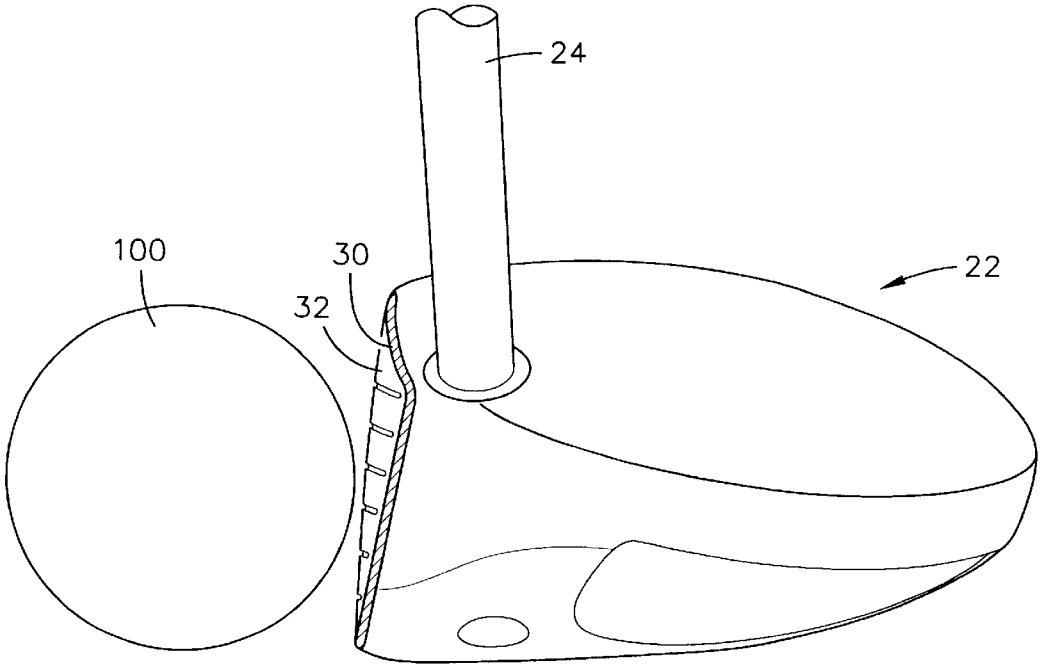
FIG. 14 is a side view of a golf club head of the present invention immediately prior to low swing speed impact with a golf ball.
Figure 15:
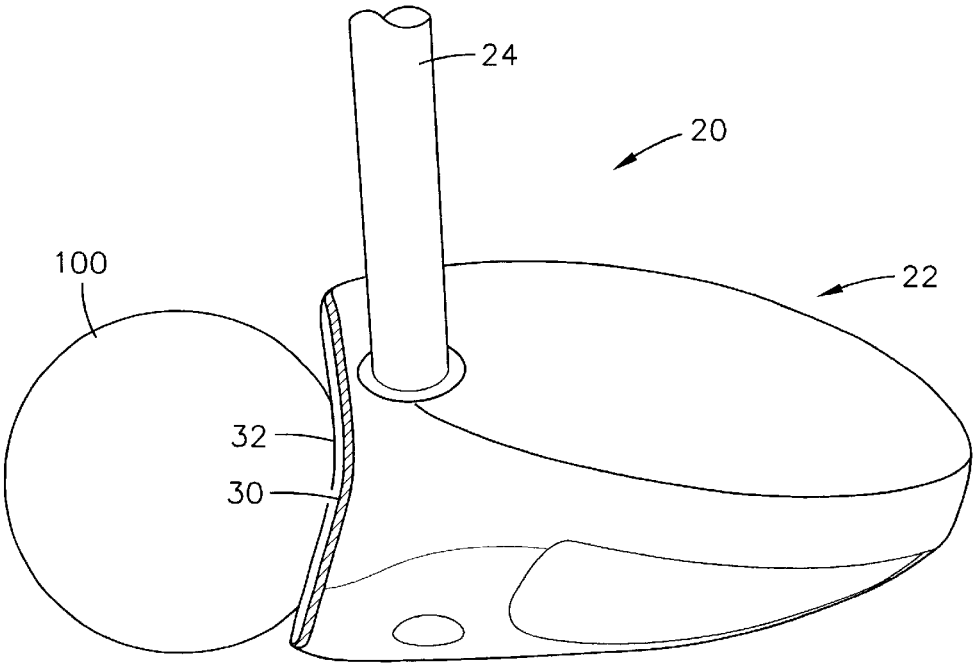
FIG. 15 is a side view of a golf club head of the present invention during low swing speed impact with a golf ball.
Figure 16:
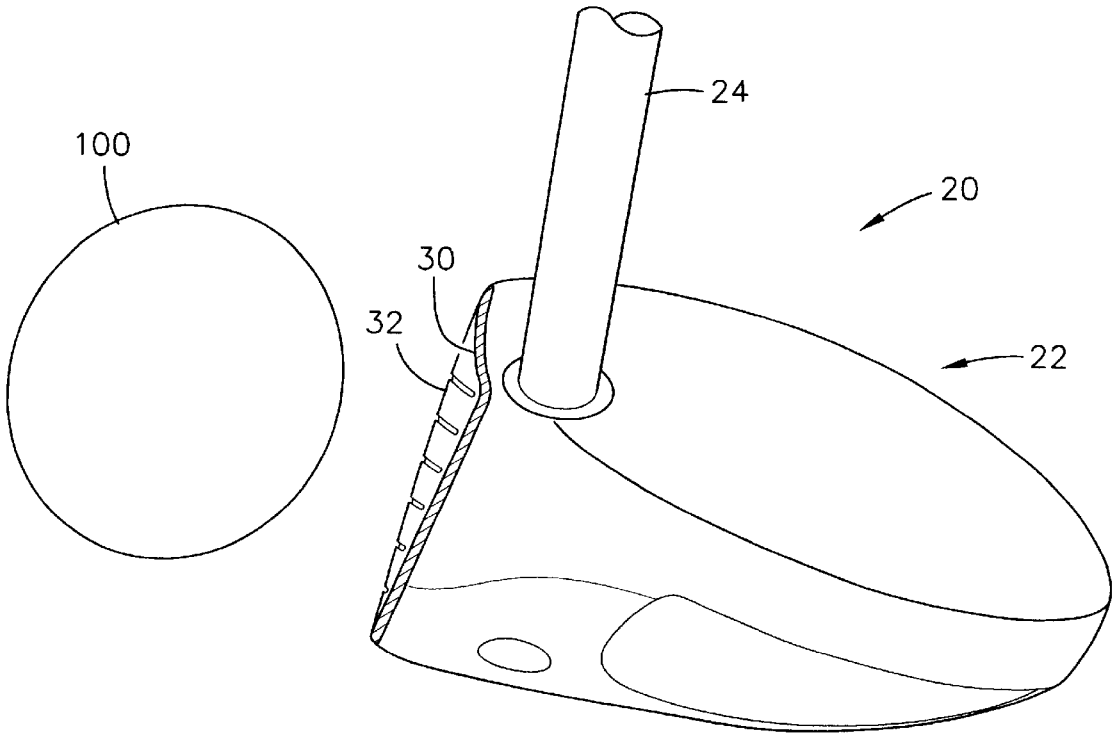
FIG. 16 is a side view of a golf club head of the present invention immediately after low swing speed impact with a golf ball.

As shown in FIGS. 14–16, the flexibility of the striking plate 26 allows for a greater coefficient of restitution during impact with a golf ball. At FIG. 14, the striking plate 32 is immediately prior to striking a golf ball 100. At FIG. 15, the striking plate 32 is engaging the golf ball, and deformation of the golf ball 100 and striking plate 32 is illustrated. A lesser deformation of the golf ball 100 and increased contact time leads to a lower loss of energy thereby increasing the coefficient of restitution. At FIG. 16, the golf ball 100 has just been launched from the striking plate 32.

Figure 17:
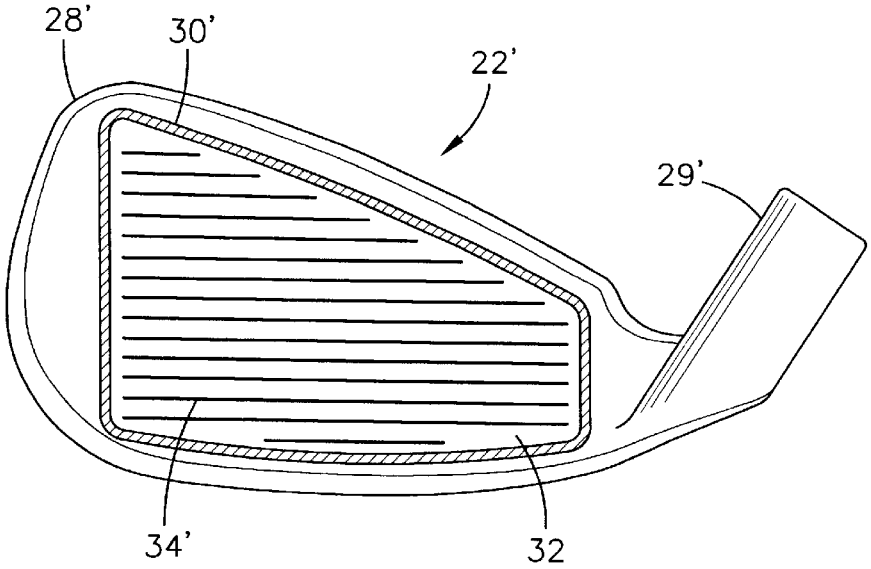
FIG. 17 is a front view of a iron golf club head embodiment of the present invention.

The golf club head of the present invention may be a wood-type, an iron-type or even a putter-type golf club head. FIG. 17 illustrates an iron type golf club head 22'. The golf club head 22' has a body 28' with a annular deflection enhancement member 30' and a striking plate 32'. The striking plate 32' has a plurality of scorelines 34' thereon. The iron golf club head 22' also has a hosel 29' for engagement of a shaft therewith. The iron golf club head 22' has a shallow hollow interior 44', not shown, that allows for compliance of the striking plate 32' during impact with a golf ball.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A wood-type golf club head comprising:

a body having a hollow interior and a face opening thereto;

a striking plate having an exterior surface and an interior surface and composed of a titanium material having a Young's Modulus of approximately $1.1\times10^{11}$ Pascals and a thickness ranging from 0.010 inch to 0.200 inch; and an annular deflection enhancement member disposed between the body and the striking plate, the annular deflection enhancement member composed of a material having a Young's Modulus less than $0.825\times10^{11}$ Pascals and selected from the group consisting of copper, aluminum, brass and magnesium, the annular deflection enhancement member isolating the striking plate from the body;

wherein the golf club head has a coefficient of restitution greater than 0.83.

2. The wood-type golf club head according to claim 1 wherein the annular deflection enhancement member comprises a plurality of portions.

3. The wood-type golf club head according to claim 1 wherein the annular deflection enhancement member has an "H" cross-sectional shape.

4. The wood-type golf head according to claim 1 wherein the annular deflection enhancement member has an "L" cross-sectional shape.

5. The wood-type golf head according to claim 1 further comprising a pin for connecting the striking plate and the annular deflection enhancement member to the body.

6. A wood-type golf club head comprising:

a body having a hollow interior and a face opening thereto;

a striking plate having an exterior surface and an interior surface and composed of stainless steel and having a Young's Modulus of approximately $2\times10^{11}$ Pascals, and a thickness ranging from 0.010 inch to 0.200 inch; and an annular deflection enhancement member disposed between the body and the striking plate, the annular deflection enhancement member composed of a material selected from the group consisting of copper, brass, aluminum and magnesium, and having a Young's Modulus less than $1.5\times10^{11}$ Pascals, the annular deflection enhancement member isolating the striking plate from the body;

wherein the golf club bead has a coefficient of restitution greater than 0.83.

7. A wood-type golf club head comprising:

a body having a hollow interior and a face opening thereto;

a striking plate having an exterior surface and an interior surface and composed of a graphite material having a Young's Modulus of ranging from $3\times10^{10}$ Pascals to $20\times10^{10}$ Pascals, and a thickness ranging from 0.010 inch to 0.200 inch; and an annular deflection enhancement member disposed between the body and the striking plate, the annular deflection enhancement member composed of a polyurethane material and having a Young's Modulus less than $2\times10^{10}$ Pascals, the annular deflection enhancement member isolating the striking plate from the body; wherein the golf club head has a coefficient of restitution greater than 0.83.

* * * * *